US005685418A

United States Patent [19]

Chong et al.

[11] Patent Number: 5,685,418

[45] Date of Patent: Nov. 11, 1997

[54] SWITCH DEVICE HAVING DETACHABLE GRASP SUPPORT MEMBER

[75] Inventors: Kok Huat Chong, San Diego, Calif.; Julio Cesar Castañeda, Coral Springs, Fla.

[73] Assignee: Motorola, Inc., Schaumburg, Ill.

[21] Appl. No.: 781,554

[22] Filed: Jan. 9, 1997

Related U.S. Application Data

[63] Continuation of Ser. No. 520,361, Aug. 28, 1995, abandoned.

[51] Int. Cl.[6] ..... H01H 1/00

[52] U.S. Cl. ..... 200/284; 200/283; 200/244; 200/61.08; 29/622

[58] Field of Search ..... 200/284, 283, 200/239, 244, 245, 246, 61.08, 275; 29/622

[56] References Cited

U.S. PATENT DOCUMENTS

| | | | |
|---|---|---|---|
| 3,704,514 | 12/1972 | Fuchs et a. | 29/622 |
| 4,490,903 | 1/1985 | Agatahama | 29/622 |
| 4,753,000 | 6/1988 | Stearns | 29/622 |
| 4,887,347 | 12/1989 | Hikita | 29/622 |
| 5,147,990 | 9/1992 | Dionisio | 200/16 |
| 5,278,993 | 1/1994 | Reiff | 455/90 |

*Primary Examiner*—David J. Walczak

*Attorney, Agent, or Firm*—Andrew S. Fuller

[57] ABSTRACT

A switch device (100) has a configuration that supports installation. The switch device (100) has two segments (110, 120) that have selectively coupled contact portions (130, 113). The two segments (110, 120) are joined together by a detachable grasp member (140) to form a continuous structure. The detachable grasp member (140) is detached from the two segments (110, 120), when the switch device (100) is installed, to separate the two segments (110, 120) except for the selectively coupled contact portions (130, 113).

20 Claims, 4 Drawing Sheets

SWITCH DEVICE HAVING DETACHABLE GRASP SUPPORT MEMBER

This is a continuation of application Ser. No. 08/520,361, filed Aug. 28, 1995, and now abandoned.

TECHNICAL FIELD

This invention relates in general to switches, and more particularly, to mechanical switches actuated on contact.

BACKGROUND OF THE INVENTION

Mechanical switches are often used in electronic devices to support operator activated functions. In a typical application, a mechanical switch may be used to operate of an ON/OFF function of a particular device. For example, a radio communication device may have a flip door, that when open and closed, activates a mechanical switch that turns the radio communication device on and off.

Mechanical switches are common in the prior art and have a variety of constructions. Many known mechanical switch designs incorporate multiple parts that are assembled together in a single device. In an application in which a simple mechanically actuated switch is desired, prior art solutions typically rely on a multi-part switch using components that must be accurately assembled relative to each other, or a more expensive pre-assembled switch device. With ongoing efforts to provide cost effective solutions for various product designs, it is desirable to provide a mechanical switch of simple construction which can be easily incorporated into an electronic product using automated assembly techniques. Therefore, a new cost effective mechanical switch of simple construction is needed.

DETAILED DESCRIPTION OF THE PREFERRED EMBODIMENT

Figure 1:
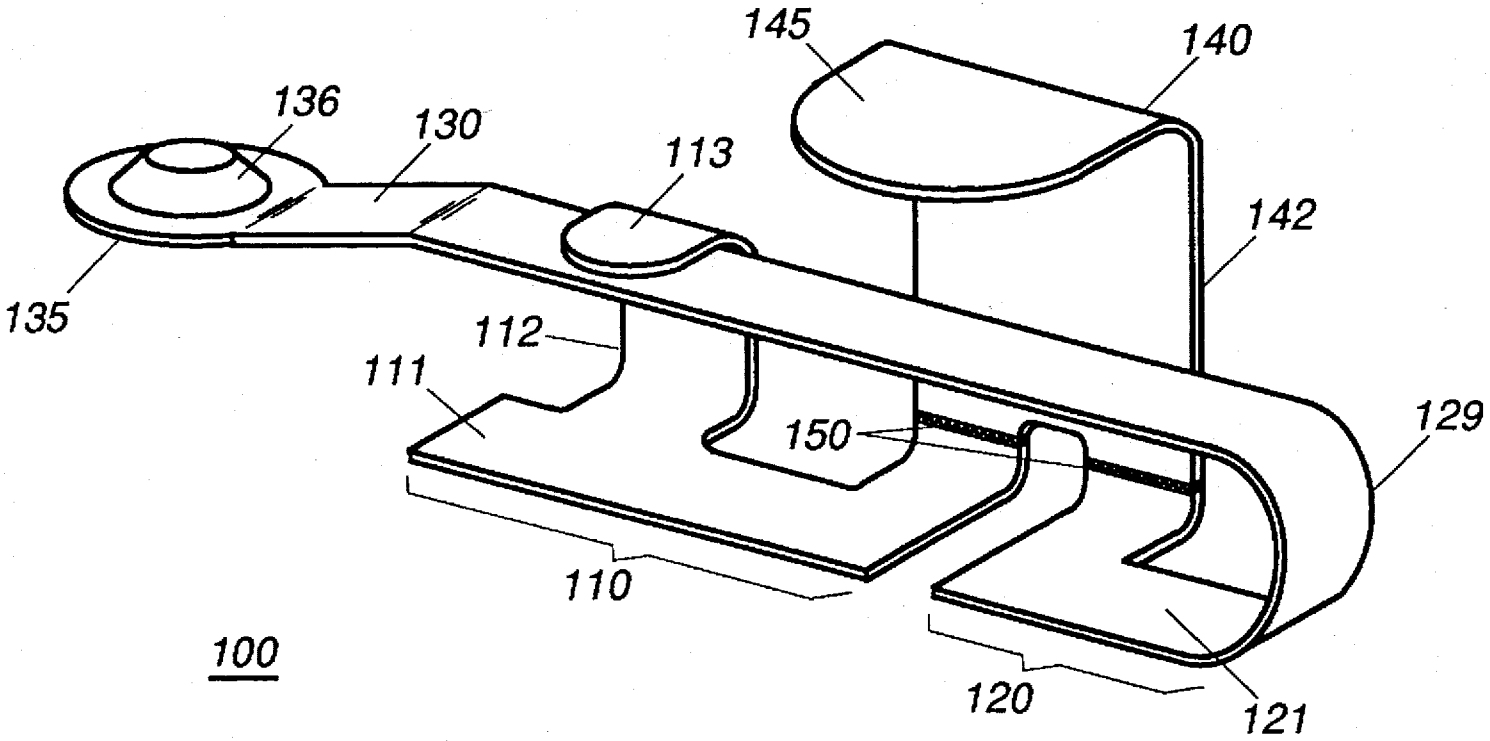
FIG. 1 shows a one-piece switch device having a detachable grasp support member, in accordance with the present invention.

While the specification concludes with claims defining the features of the invention that are regarded as novel, it is believed that the invention will be better understood from a consideration of the following description in conjunction with the drawing figures, in which like reference numerals are carried forward.

Generally, the present invention provides for a switch device having a detachable member to support installation onto a support member. The switch device is preferably of a one-piece construction and includes two switch segments, and a detachable member with a grasp support portion, joining the two switch segments. When the one piece structure is mounted to the support member, the detachable member is removed, so as to separate the two switch segments. Preferably, one of the switch segments has a portion which is moveable to engage with and disengage from the other switch segment, thereby forming an operable switch device.

Referring now to FIG. 1, a switch device 100 having a one-piece construction is shown, in accordance with the present invention. The switch device includes two switch segments 110,120 that form complementary switch contact portions for selective electrical coupling. A first segment 110 includes a mount portion 111, and a contact portion 113 in the form of a overhang that extends over the mount portion 111. The contact portion 113 and mount portion 111 are attached via a sidewall 112. The second switch segment 120 also has a mount portion 121 which preferably is coplanar or substantially co-planar with the mount portion 111. The second segment 120 includes a cantilever arm or contact portion 130 attached to the mount portion 121 by a mechanically stressed section 129. The mechanically stressed section 129 is formed to spring bias the cantilever arm 130 in a particular direction. Preferably, the cantilever arm 130 is positioned to extend over the mount portion 121, and between the mount portion 111 and the contact portion 113 of the first segment 110. Accordingly, the cantilever arm 130 is spring biased against the contact portion 113. The cantilever arm 130 is moveable between a position abutting the contact portion 113 and a position away from the contact portion 113. An angled portion 135 of the cantilever arm 130 has an actuator section 136 for the selective application of an actuation force to decouple the cantilever arm 130 and contact portion 113.

Both switch segments 110, 120 are joined together by a detachable or removable grasp support frame member 140, which is attached to the two segments 110, 120 by a weakened juncture 150. Preferably, the grasp support member 140 has a flat portion 145 forming a planar grasp support surface that overhangs at least a portion of the cantilever arm 130 and a section of the mount portions 111, 121. The planar portion of the grasp support member 140 is attached to the first and second segments 110, 120 by a sidewall 142 at the weakened juncture 150.

Preferably, the first and second switch segments 110, 120, including the cantilever arm 130, and the removable frame member 140, all constitute or form a single continuous metal part. In the preferred embodiment, the switch device is formed entirely from stamped sheet metal, or other conductive material. When formed, the cantilever arm 130 is angled away from the first segment 110 beyond contact 113. The cantilever arm 130 is then forcibly placed between the contact 113 and the mount portion 111 of the first segment 110, by bending at section 129 to create a spring load that biases the cantilever arm 130 against the contact 113.

Figure 2:
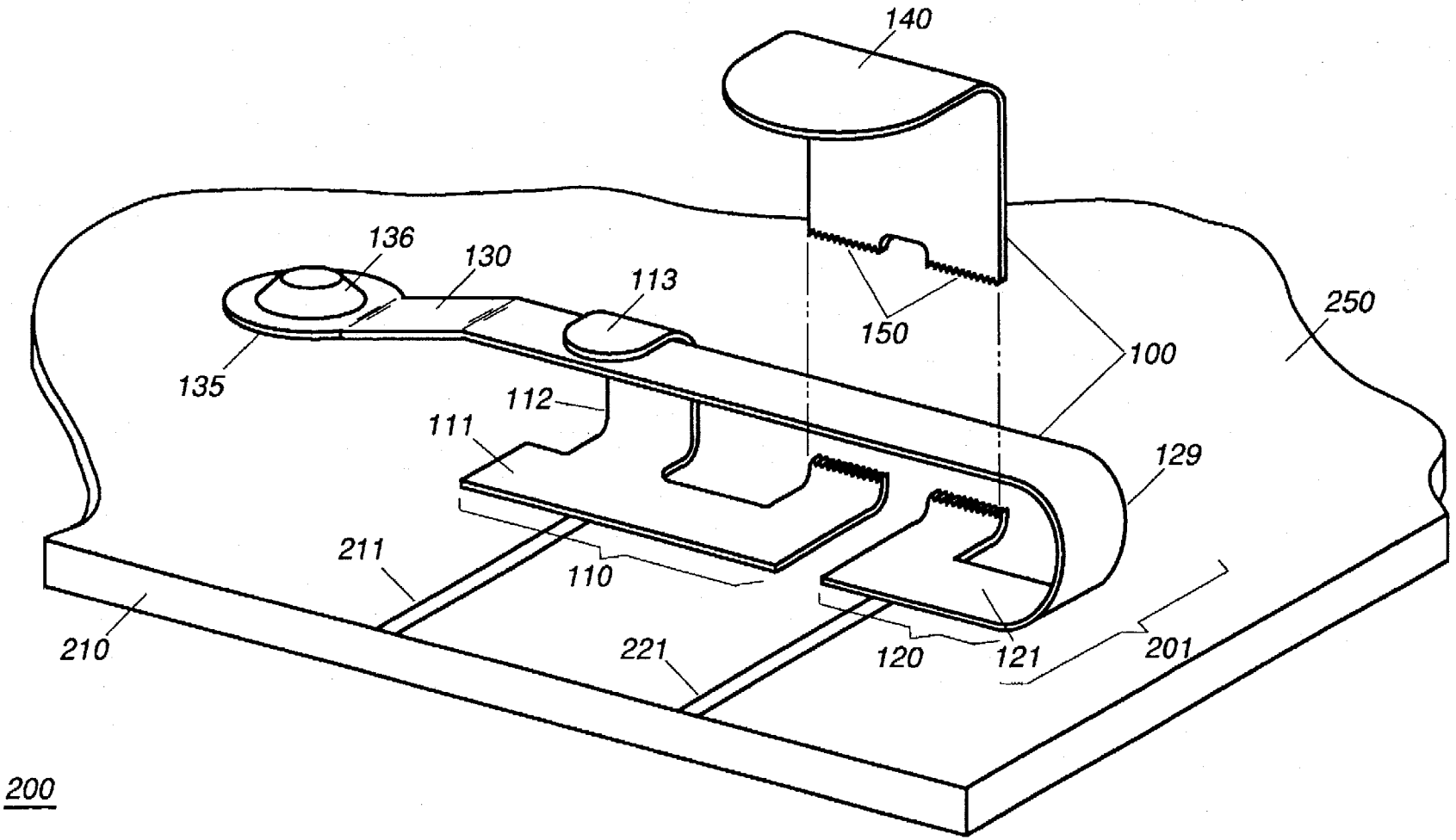
FIG. 2 shows the switch device of FIG. 1 installed on a support surface, in accordance with the present invention.

Referring to FIG. 2, a switch device assembly 200 is shown, in accordance with the present invention. The switch device assembly 200 includes the switch device 100 installed on a support surface 250, such as by soldering to a circuit substrate 210. Preferably, the first and second mount portions 111, 121 are electrically coupled to conductors 211, 221 respectively. In the preferred embodiment, the grasp support member 140 is used by an automated placement machine (not shown) to accurately place the switch device 100. After the switch device 100 is installed, the removable frame member 140 bridging the first and second switch segments 110, 120 is detached, such as by breaking at the weakened juncture 150. The detached frame member 140 is then discarded leaving a functional switch device 201. The one-piece construction facilitates automated placement and avoids potential problems associated with alignment and relative placement of the first and second switch segments 110, 120. In the preferred embodiment, the resultant switch device 201 is spring biased in a closed position, i.e., the cantilever arm 130, which is attached to the second segment 120, is biased against the contact portion 113 of the first segment 110, thereby creating a conductive path between the conductors 211, 221.

Figure 3:
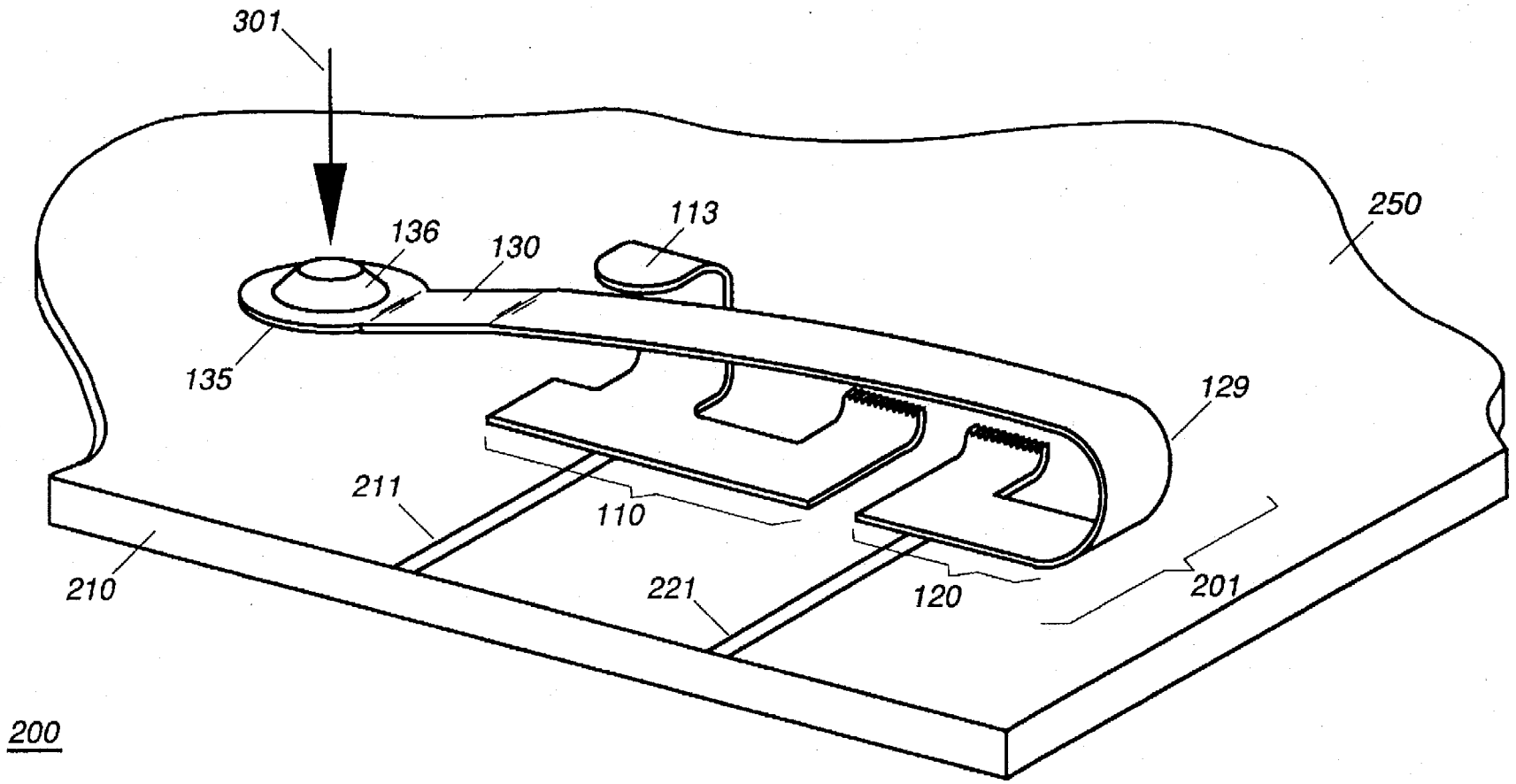
FIG. 3 shows operation of the switch device of FIG. 2 with a mechanically actuated portion, in accordance with the present invention.

FIG. 3 shows the installed switch device 201 in an open position, in accordance with the present invention. The switch 201 is opened by applying a mechanical force 301 to actuate the cantilever arm 130 and disengage it from the contact portion 113 of the first switch segment 110. When the cantilever arm 130 is sufficiently depressed, the angled portion 135 of the cantilever arm 130 makes contact with the support surface thereby avoiding engagement between the cantilever arm 130 and the mount potion 111 of the first switch segment 110. Preferably, the cantilever arm is moved by actuating the actuator portion 136 thereof. Thus, the cantilever arm 130 is moveable from a position engaging the contact portion of the first segment (as seen in FIG. 2), to a second position disengaged or removed from the first switch segment 110, to provide for selectively coupled contact portions.

Figure 4:
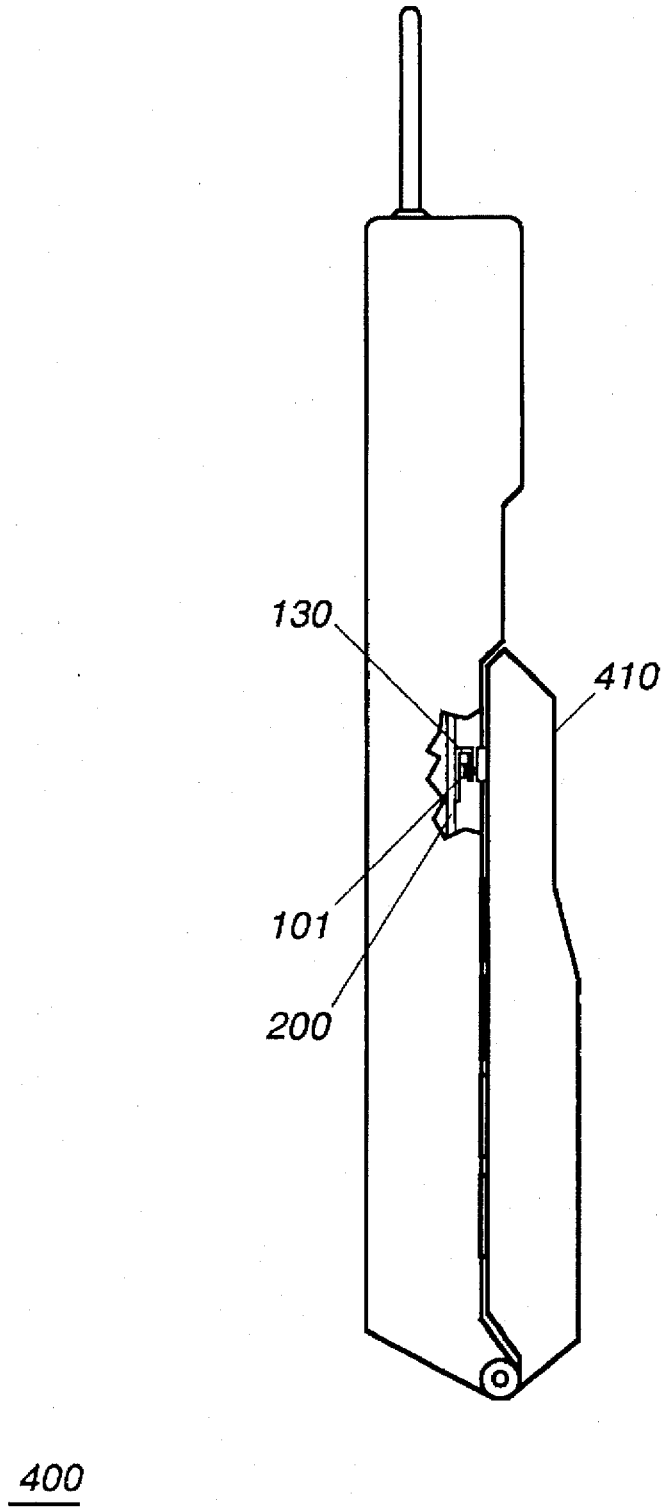
FIG. 4 shows a radio communication device with the switch device of FIG. 1 installed therein, in accordance with the present invention.

Referring to FIG. 4, a radio communication device 400 having the switch assembly 200 installed therein is shown, in accordance with the present invention. The radio communication device 400 is an electronic assembly that includes communication circuitry for supporting two way communications over a radio frequency channel, as is well known in the prior art. In the radio communication device 400 of the preferred embodiment, a flip door 410 provides for selective actuation of the switch device 201 by selective actuation of the actuator section 136.

The present invention provides significant advantages over mechanical switches of the prior art. The switch device has a configuration that supports automated installation via the detachable grasp support member. The switch device includes two segments having selectively coupled contact portions. The two segments are joined together by detachable grasp member to form a continuous structure which can be easily placed by an automated placement machine. Once the switch device is installed and secured on a support substrate, the detachable grasp member is detached to separate the two segments except for the selectively coupled contact portions. In the preferred embodiment, the switch device is formed in a one piece construction from stamped metal thereby providing a cost effective solution to a mechanical switch. The simple construction, ease of installation, and relatively low cost, provide substantial advantages for a switch device constructed according to the present invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A switch assembly, comprising:

a circuit substrate having first and second electrical conductors;

a switch device having a one-piece structure when mounted to the circuit substrate, the switch device comprising:

first and second switch segments coupled to the first and second electrical conductors, respectively;

a detachable member joining the first and second switch segments, the detachable member having a grasp support portion;

wherein:

the first and second switch segments, and the detachable member together form the one-piece structure when mounted to the circuit substrate; and the detachable member is detached from the first and second switch segments after the one-piece structure is mounted to the to the circuit substrate to form an operable switch device.

2. The switch assembly of claim 1, wherein the second switch segment comprises a portion operably movable to engage with and disengage from the first switch segment.

3. The switch assembly of claim 2, wherein:

the first switch segment comprises a contact portion; and the portion of the second switch segment comprises a cantilever arm that is spring biased toward the contact portion.

4. The switch assembly of claim 3, wherein:

the first switch segment comprises a first mount portion; and the second switch segment comprises a second mount portion co-planar with the first mount portion.

5. The switch assembly of claim 3, wherein the first and second switch segments, including the cantilever arm, and the detachable member, all form a single continuous metal part.

6. A switch device having a configuration that supports automated installation on a circuit carrying substrate, the switch device comprising two segments having selectively coupled contact portions, the two segments being joined together by a detachable grasp member to form a complete continuous one-piece structure that installs directly on the circuit carrying substrate, wherein the detachable grasp member is detached from the two segments, after the switch device is installed on the circuit carrying substrate, to separate the two segments except for the selectively coupled contact portions.

7. The switch device of claim 6, wherein the switch device consists of the two segments and the detachable grasp member, which are formed from stamped metal.

8. The switch device of claim 7, wherein the detachable grasp member is attached to the two segments by a weakened juncture.

9. A switch device comprising:

a first switch segment having a first mount portion and a contact portion;

a second switch segment, having a second mount portion, and a cantilever portion movable between a first position abutting the contact portion and a second position removed from the contact portion; and a removable frame member bridging the first and second switch segments;

wherein;

the first and second switch segments, including the cantilever potion, and the removable frame member constitute a single continuous metal part upon installation of the switch device; and the removable frame member has an overhang portion that extends over the first and second switch segments and that is attached to the first and second switch segments by a weakened juncture that facilitates removal of the removable frame member.

10. The switch device, comprising:

a first switch segment having a first mount portion and a contact portion;

a second switch segment, having a second mount portion, and a cantilever portion movable between a first position abutting the contact portion and a second position removed from the contact portion; and a removable frame member bridging the first and second switch segments;

wherein:

the first and second switch segments, including the cantilever portion, and the removable frame member, constitute a single continuous metal part; and the removable frame member has a planar grasp support surface that overhangs the second mount portion, and a sidewall that attaches to the first and second mount portions.

11. The switch device of claim 10, wherein the sidewall has a weakened juncture.

12. The switch device of claim 10, wherein the contact portion comprises a overhang that extends over the first mount portion.

13. The switch device of claim 10, wherein the first and second mount portions are substantially co-planar.

14. The switch device of claim 10, wherein the cantilever portion has an actuator section.

15. The switch device of claim 14, wherein actuation of the cantilever portion selectively electrically couples and decouples the first and second switch segments, when the removable frame member is removed.

16. The switch device of claim 9, wherein the cantilever portion has a section angled to avoid engaging the first mount portion when the cantilever portion is biased to disengage from the first switch segment.

17. A switch device having a one-piece structure for mounting to a support surface, comprising:

a first switch segment having a first mount portion, and a contact portion;

a second switch segment having a second mount portion co-planar with the first mount portion, the second switch segment having a cantilever arm that is spring biased toward the contact portion, and that is operably movable to engage with and disengage from the first switch segment, wherein the cantilever am has a section angled to avoid engaging the first mount portion when the cantilever arm is biased to disengage from the first switch segment;

a detachable member joining the first and second switch segments, the detachable member having a grasp support portion;

wherein:

the first and second switch segments, and the detachable member together form the one-piece structure; and the detachable member is detached from the first and second switch segments when the one-piece structure is mounted to the support surface, thereby forming an operable switch device.

18. The switch device of claim 17, wherein the detachable member is attached to the first and second switch segments by a weakened juncture.

19. The switch device of claim 17, wherein the contact portion comprises a overhang that extends over the first mount portion.

20. The switch device of claim 17, wherein the detachable member comprises a overhang that extends over the first and second mount portions.

* * * * *

UNITED STATES PATENT AND TRADEMARK OFFICE

CERTIFICATE OF CORRECTION

PATENT NO. : 5,685,418

DATED : November 11, 1997

INVENTOR(S) : Chong, et al.

It is certified that error appears in the above-identified patent and that said Letters Patent is hereby corrected as shown below:

Column 4, claim 9, line 55, delete "potion" and insert therefor -- portion --.

Signed and Sealed this

Seventeenth Day of November, 1998

*Attest:*

Bruce Lehman

BRUCE LEHMAN

*Attesting Officer*

*Commissioner of Patents and Trademarks*